US009080406B2

(12) United States Patent
Kelleher et al.

(10) Patent No.: US 9,080,406 B2
(45) Date of Patent: Jul. 14, 2015

(54) REMOTE GAS MONITORING APPARATUS FOR SEABED DRILLING

(75) Inventors: Patrick Joseph Kelleher, New South Wales (AU); Stephen David Payor, New South Wales (AU)

(73) Assignee: BENTHIC GEOTECH PTY LTD, New South Wales (AU)

( * ) Notice: Subject to any disclaimer, the term of this patent is extended or adjusted under 35 U.S.C. 154(b) by 639 days.

(21) Appl. No.: 11/574,921

(22) PCT Filed: Sep. 5, 2005

(86) PCT No.: PCT/AU2005/001347
§ 371 (c)(1),
(2), (4) Date: Aug. 22, 2007

(87) PCT Pub. No.: WO2006/032076
PCT Pub. Date: Mar. 30, 2006

(65) Prior Publication Data

US 2008/0115971 A1 May 22, 2008

(30) Foreign Application Priority Data

Sep. 21, 2004 (AU) ..... 2004905412

(51) Int. Cl.
*E21B 43/01* (2006.01)
*E21B 21/08* (2006.01)
(Continued)

(52) U.S. Cl.
CPC ..... *E21B 21/08* (2013.01); *E21B 21/001* (2013.01); *E21B 21/067* (2013.01);
(Continued)

(58) Field of Classification Search
USPC ..... 702/6
See application file for complete search history.

(56) References Cited

U.S. PATENT DOCUMENTS 4,208,906 A 6/1980 Roberts, Jr.
4,450,711 A * 5/1984 Claude ..... 73/40.5 R
(Continued)

FOREIGN PATENT DOCUMENTS

CA 2580091 * 3/2006 ..... E21B 43/01
EP 0624799 A2 11/1994
(Continued)

OTHER PUBLICATIONS http://www.wipertrip.com/well-control/planning/478-shallow-gas-planning-guidelines.html, printed Feb. 25, 2014, 3 pages.*
(Continued)

*Primary Examiner* — Tung S Lau
(74) *Attorney, Agent, or Firm* — King & Schickli, PLLC

(57) ABSTRACT

Gas monitoring apparatus associated with a remotely operated seabed system, the apparatus including a detector which is adapted so as to enable detection and/or measurement in real time the interception of shallow gas in a bore hole. In one form the gas monitoring apparatus is suitable for use with a drilling rig for drilling into a sea bed, the drilling rig including a drill string. The gas monitoring apparatus includes a housing with a collecting chamber therein for receiving drilling fluid returns which result from a drilling operation. The apparatus further includes a discharge conduit for discharging the drilling fluid returns from the collecting chamber, the collecting chamber and discharge conduit being configured so that the drilling fluid is discharged in a stratified flow which includes a predominantly dissolved gas containing phase, and if present a free gaseous phase. A gas sensor is associated with the discharge conduit and positioned so as to sense any gas in the predominantly dissolved gas containing phase and transmit the measured gas concentration signal in real-time to a surface operating station. In another form the apparatus includes a gas monitoring probe assembly suitable for use with a drilling rig for drilling into a sea bed, the gas monitoring probe assembly including a housing attachable to one end of a drill string of the rig and which includes a gas sensor having a gas sensor face within the housing.

15 Claims, 4 Drawing Sheets

(51) Int. Cl.

| | |
|---|---|
| ***E21B 21/00*** | (2006.01) |
| ***E21B 21/06*** | (2006.01) |
| ***E21B 33/035*** | (2006.01) |
| ***E21B 33/038*** | (2006.01) |
| ***E21B 43/36*** | (2006.01) |
| ***E21B 49/00*** | (2006.01) |
| ***E21B 49/08*** | (2006.01) |

(52) U.S. Cl.

CPC ..... *E21B 33/035* (2013.01); *E21B 33/038* (2013.01); *E21B 43/36* (2013.01); *E21B 49/001* (2013.01); *E21B 49/08* (2013.01); *E21B 2043/0115* (2013.01)

(56) References Cited

U.S. PATENT DOCUMENTS

| | | | | |
|---|---|---|---|---|
| 4,535,851 | A | 8/1985 | Kirkpatrick et al. | |
| 5,006,845 | A | 4/1991 | Calcar et al. | |
| 5,635,653 | A | 6/1997 | Wittig et al. | |
| 5,937,946 | A | 8/1999 | Streetman | |
| 5,992,213 | A | 11/1999 | Tartre | |
| 6,004,385 | A | 12/1999 | Birmingham | |
| 6,138,774 | A * | 10/2000 | Bourgoyne et al. | 175/7 |
| 6,209,642 | B1 | 4/2001 | Streetman | |
| 6,315,813 | B1 | 11/2001 | Morgan et al. | |
| 6,413,297 | B1 | 7/2002 | Morgan et al. | |
| 6,456,385 | B1 | 9/2002 | Rolling et al. | |
| 6,540,021 | B1 | 4/2003 | Botrel | |
| 2001/0004017 | A1 | 6/2001 | Lopes | |
| 2003/0132028 | A1 * | 7/2003 | Edvardsen | 175/5 |

FOREIGN PATENT DOCUMENTS

| | | | |
|---|---|---|---|
| EP | 0932054 | A2 | 7/1999 |
| FR | 2798158 | A1 | 3/2001 |
| WO | 9110132 | A1 | 7/1991 |
| WO | 9218750 | A1 | 10/1992 |
| WO | 9945228 | A1 | 9/1999 |
| WO | 0250398 | A1 | 6/2002 |
| WO | WO 03/053773 | A1 | 7/2003 |

OTHER PUBLICATIONS

Supplementary European Search Report EP 05 77 7938 Apr. 19, 2013 4 Pages.

Issues Surrounding a Shallow Gas Database in Relation to Offshore Hazards (OTH 504) Offshore Technology Report Series R. Holmes, Health and Safety Commission Staff, S. A. Alexander, K. C. Ball, Great Britain. Health and Safety Executive, J. Bulat, Queen's University of Belfast Evans, D. Long, C. D. MacBeth, M. McCormac, M. J. Sankey HSE Books, 1997.

* cited by examiner

REMOTE GAS MONITORING APPARATUS FOR SEABED DRILLING

FIELD OF THE INVENTION

This invention relates generally to the monitoring of shallow gas in a seabed. The term "seabed" is intended to cover the ground under any body of water such as for example, the sea, ocean, lake, river, dam, and the like.

The apparatus according to the various aspects of the present invention is suitable for use with remotely operated drilling rigs for the seabed. The expression drilling rigs is intended to include all forms of rigs which enable the penetration of the seabed. This may be achieved by drilling or other means of penetration.

Thus where reference is made to a drilling operation this includes within its scope other operations by which penetration of the seabed is effected. Further where reference is made to drilling rigs and drill strings which form part of the rig this again includes within its scope equipment which enables penetration of the seabed for analysis sampling and the like.

BACKGROUND

Drilling of the seabed is widely conducted for a number of purposes including geotechnical sampling and testing, offshore hydrocarbons exploration, geohazards identification, and specific scientific studies. Such drilling activities can encounter shallow gas deposits in the seabed that can present potentially serious hazards to operations. Seabed gas may originate from decomposition of marine organisms within shallow sedimentary layers or it may seep from deep hydrocarbon sources. Such gas deposits can be toxic and/or explosive and can be confined within the seabed at high pressure.

In certain regimes of high pressure and low temperature, at water depths beyond 300 meters, marine sediments may contain gas hydrates close beneath the sea floor.

Hydrates are quasi-stable solid phase gas-water structures that can significantly influence the strength and stability of the seafloor sediments in which they occur. Gas hydrates are thus an important consideration in offshore geohazards (apart from attracting interest as a potential energy resource), especially in areas where deepwater oil and gas exploration and exploitation activities can alter soil conditions to the extent that rapid destabilization of the seafloor may occur.

In some cases the presence of shallow gas can be recognised by survey prior to commencement of drilling, where pock marks and/or shallow depressions are identified on the seabed. Gas hydrate sediments and underlying free gas may be indicated on seismic records, appearing as a bottom simulating reflector. In other cases, particularly where impervious layers exist in the seabed, the presence of shallow gas deposits may not be immediately evident from seabed features, and thus may be encountered unexpectedly.

Seabed drilling operations may be carried out from a surface platform such as a drillship, jack-up rig or semi-submersible drilling rig, in which case the drillstring extends through a riser in the water column and into the borehole. In a less expensive alternative form of seabed drilling and sampling, operations are carried out via a remotely controlled system, deployed to the seafloor on an umbilical from a surface vessel. In this case the drillstring extends into the borehole only from the seabed rig and the surface vessel need not be stationed directly above the borehole.

Interception of a borehole with a shallow gas deposit may allow release of toxic and/or flammable gas such as hydrogen sulphide and methane which, if vented to the surface near a drilling vessel, can endanger health and safety of personnel and safety of equipment. In the case of drilling equipment supported on the seabed, release of high pressure gas can result in a sudden and uncontrolled loss of seabed bearing strength or possible scouring and undermining of the equipment footings. Such events may destabilise the equipment, with resultant damage and loss of productivity through tilting or toppling. Drilling operations through hydrates can cause pressure and temperature changes which may result in rapid dissociation of the hydrates and consequent blowouts and/or destabilisation of the seafloor.

When samples are taken for geotechnical assessment from seabed sediments in deep water they undergo extreme pressure relief as they are brought to the surface. Gases dissolved in the pore water may come out of solution and cause sample disturbance, which can impact significantly on sample quality and subsequent interpretation of laboratory test results. Knowledge of the strength characteristics of marine sediment soils in which gas hydrate deposits can occur is vital to the economic establishment of seabed infrastructure. It is therefore an important step to know the in situ dissolved gas content and degree of saturation.

Detection, monitoring and measurement of shallow gas occurrence are therefore important aspects of seabed drilling, sampling and geotechnical investigation. In conventional practice this may involve (a) monitoring of drilling returns at the surface and (b) deployment of gas sampling probes in the borehole.

(a) Drilling Returns Monitoring

For drilling operations generally, drilling fluid or mud is pumped to the cutting bit through the drill pipe to cool and lubricate the bit and to remove cuttings from the borehole. The drilling mud returned from the borehole carries with it a continuous sample of material representative of the geological formations being penetrated by the drill bit, including free and dissolved gases released from the soil matrix. The drilling mud 'returns' typically flow up the annular passage between the rotating drill pipe and the surrounding casing pipe.

In the form of seabed drilling where operations are carried out from a surface vessel or platform, a mud logging system is typically used. This includes monitoring and analysis of gases liberated from the returned drilling mud before it passes back to the holding tank. Various sensors or high speed gas chromatography instruments measure the presence of hydrogen sulphide and of hydrocarbons, particularly those of low molecular weight such as methane. When operating at great water depth there is however, a significant measurement lag due to the time taken for the drilling mud returns to travel from the borehole to the surface measurement zone. Unexpected interception of a high pressure gas pocket may cause a sudden rise or 'kick' in pressure in the drill string and possible gas blow-out in extreme cases, necessitating the use of blow-out prevention equipment.

In the form of seabed drilling where operations are carried out via a remotely operated system, the drilling fluid may be seawater drawn from the immediate surrounds, or seawater mixed to a desired ratio with a synthetic mud concentrate, prior to pumping down the drillstring to the cutting bit. In this case the drilling mud is not recycled, but discharged at the seafloor together with the cuttings from the borehole. Such remotely operated seabed systems are not commonly equipped with means for blow-out prevention and are currently disadvantaged in lacking gas monitoring capability. They are therefore unable to detect whether the borehole may be approaching or intersecting shallow gas deposits, or to forewarn the drilling operator that a potentially unsafe condition is developing.

(b) Gas Sampling Probes

Sampling probes such as the NGI Deepwater Gas Probe are conventionally used to obtain samples of in situ pore water that can be analysed for content of gas. These probes have an internal container that can be opened and closed to seal off a pore water sample, together with temperature and pressure logging instrumentation. There is however no means of communication with the probe during the test, which gives rise to a number of disadvantages in that no data is available in real time; logged measurements must await retrieval of the probe back to the surface; required sampling times and sampling intervals must be pre-programmed prior to launch, based on an assumed knowledge of waiting time and soil conditions. The lack of in situ measurement capability requires on-board laboratory facilities and contributes further delay while results are obtained from separate instrumental analysis of the pore water gas content.

Another form of sampling, with particular application in the case of gas hydrates, involves the use of pressurised coring tools such as the HYACE Rotary Corer and the Fugro Pressure Corer. Gas hydrates are naturally occurring unstable compounds that rapidly dissociate at normal atmospheric pressure. Pressurised tools allow samples to be autoclaved and brought intact to the surface at their natural in situ pressure for various physical measurements and geochemical analysis. While useful for ground truthing and other studies, pressurised corers are currently limited to large diameter tools unsuitable for deployment via remotely operated seabed systems.

As used herein, the phrase 'remotely operated seabed system' generally refers to the situation where the drilling tools and/or downhole probes are deployed robotically or otherwise down the borehole from a seabed platform or other type of vehicle rather than manually from a surface platform. Communication from the probe to the seabed platform/system may be by wire(s), cable(s) and/or by wireless means. Communication between the seabed system and the surface vessel (remote operator station) is by wire and/or cable (e.g. electrical or optical fibre telemetry).

It is an object of the present invention to provide methods and/or apparatus which alleviates one or more of the above described disadvantages associated with detection, monitoring and sampling of seabed gas.

SUMMARY OF THE INVENTION

According to one aspect of the present invention there is provided a gas monitoring apparatus associated with a remotely operated seabed system, the apparatus including a detector which is adapted so as to enable detection and/or measurement in real time the interception of shallow gas in a bore hole.

Preferably the detector includes a collector for continuously collecting drilling fluid returns and contacting the drilling fluid returns with an underwater gas sensor.

In one form the gas monitoring apparatus is suitable for use with a drilling rig for drilling into a sea bed, the drilling rig including a drill string, the gas monitoring apparatus including a housing with a collecting chamber therein for receiving drilling fluid returns which result from a drilling operation, the drilling fluid returns including fluid containing solids from the drilling operation and, if present, dissolved gas, the apparatus further including a discharge conduit for discharging the drilling fluid returns from the collecting chamber, the collecting chamber and discharge conduit being configured so that the drilling fluid is discharged in a stratified flow which includes a predominantly dissolved gas containing phase and if present a free gaseous phase the apparatus further including one or more gas sensors associated with the discharge conduit and positioned so as to sense, any gas in the predominantly dissolved gas containing phase.

The drilling rig may further include a tubular casing which, in use, is disposed within a bore hole in the sea bed and the drill string is adapted to pass therethrough there being generally annular space between an inner wall of the tubular casing and the drill string through which the drilling fluid returns can pass. The housing may be operatively mounted to the tubular casing so that the drilling fluid returns can enter the collecting chamber. Preferably, the housing includes a passage extending therethrough, through which the drill string can pass, the collecting chamber being in fluid communication with the passage. Preferably the tubular casing extends into the passage.

The apparatus may further include seal means for sealing the collecting chamber with the drill string and the casing.

The gas sensor may include a sensing face within the discharge conduit so as to contact the predominantly dissolved gas containing phase if present. Preferably the sensing face is disposed in an upper region of the discharge conduit but spaced from a top region so as to inhibit contact with the free gaseous phase if present.

Preferably, the housing is spaced from the sea bed and the discharge conduit extends from one side of the collecting chamber and towards the sea bed.

In another form the apparatus includes a gas monitoring probe assembly suitable for use with a drilling rig for drilling into a sea bed, the drilling rig including a drill string, the gas monitoring probe assembly including a housing attachable to one end of the drill string and which includes a gas sensor having a gas sensor full within the housing.

The probe assembly may further include a soil penetrating tip at one end of the housing.

Openings or interconnecting passages may be provided to allow pore water to permeate from the borehole strata to the gas sensor face. The openings or interconnecting passages may be provided via a filter element of porous material.

The probe assembly may further include internal connecting passages between the drillstring and the gas sensor face to allow flushing of the sensor face with clean seawater. Furthermore, means for may be provided for recording and simultaneously transmitting measured data signals in real time to a remote operator station.

According to yet another aspect of the present invention there is provided a method for remotely detecting and measuring the interception of shallow gas in a borehole in association with remotely operated seabed drilling or sampling equipment, the method including the steps of continuously collecting drilling fluid returns from the borehole, segretaing the drilling fluid returns into a predominantly solids-containing aqueous phase, a predominantly dissolved gas-containing aqueous phase, if present, and a free gaseous phase, if present, permitting the dissolved gas-containing aqueous phase to flow in contact with one or more underwater gas measurement sensors while allowing the free gaseous phase to bypass the sensors.

According to yet another aspect of the present invention there is provided a method for remotely detecting and measuring the interception of shallow gas in a borehole in association with remotely operated seabed drilling or sampling equipment, the method including the steps of connecting a gas sensor probe assembly to an end of a drillstring, lowering the probe assembly into the borehole, pushing the probe into soil at the bottom of the borehole; allowing pore water from the borehole strata to permeate in contact with a gas sensor;

recording gas concentration and simultaneously transmitting measured data signals in real time to remotely operated seabed apparatus, thence to a remote operator station on a surface vessel.

Further preferred forms and alternatives of the various aspects of the invention will hereinafter be described.

Thus in the first aspect of the invention it can provide means to detect and analyse seabed gas via the drilling mud returns on a remotely operated seabed system. The collecting chamber may be provided to enclose a section of the drill-string at the top of the casing pipe, where the return flow of drilling fluid discharges from the borehole. The collecting chamber can be part of a casing guide, used to position the initial casing pipe relative to the clamp that holds the drilling rig onto the casing.

The base of the collecting chamber may be sealed around the casing pipe by a lower resilient seal of rubber or similar material. The top of the collecting chamber may be sealed around the drill pipe by an upper resilient seal of rubber or similar material, or a 'floating' type of seal able to accommodate rotational and vertical movement of the drill string. The upper seal is readily replaceable in the event of wear occurring through contact with the rotating drill pipe.

The collecting chamber may have a side outlet to which is attached a downwardly inclined discharge pipe. The upper section of the discharge pipe is arranged to house a gas sensor with its sensing face disposed into the discharge pipe, but offset circumferentially from the top of the pipe. The gas sensor is electrically wired to a power supply and telemetry interface on the seabed drilling rig. More than one gas sensor may be provided in this manner to measure different types of gases or different ranges of gas concentrations.

In operation, drilling fluid or mud which is pumped down the drill pipe picks up cuttings from the bottom of the borehole, together with any inflow of liquids and gases from the formation being penetrated by the drill bit. The resulting mixture flows from the region of highest pressure at the bottom of the borehole up through the drilling annulus (the narrow annular passage between the rotating drill pipe and the fixed casing pipe), to the region of lowest pressure at the top of the casing. There the drilling fluid mixture enters the collecting chamber and passes into the discharge pipe where the flow tends to stratify.

Cuttings particles in the coarser size fractions of sand and grit settle out of suspension as the mixture flows through the discharge pipe, while the predominantly aqueous portion containing any dissolved gases flows in contact with the gas sensor face in the upper section of the discharge pipe. The gas sensor face is thus swept by the flow of returned drilling fluid to provide a continuous measurement of dissolved gas concentration in the formation being penetrated. The measurement output signal is transmitted in real time to a remote operator station on the surface vessel.

It is important that any free gas bubbles entrained in the drilling fluid mixture cannot collect on the gas sensor face and cause the measurement signal to saturate. Free gas bubbles rise into a predominantly gaseous portion of the flow, uppermost in the discharge pipe, and bypass the gas sensor face by virtue of its positioning with respect to the stratified flow.

Continuous measurement in the manner described above can provide advance warning of a possible gas hazard with only a relatively short delay. This delay, representing the transit time of the drilling fluid returning up the drilling annulus, is determined by the depth of the cutting bit and the velocity of the fluid in the annulus.

By way of example, consider a drilling operation using a B-size drill pipe of outside diameter ($d_p$) 54 mm, a casing pipe of inside diameter ($d_c$) 60 mm, at a depth (L) of 50 m into the sub-seabed and with a drill water flow rate (F) 15 L/min.

The cross-sectional area (A) of the drilling annulus is given by the relationship $$\begin{aligned} A &= (\pi/4)(d_c^2 - d_p^2) \\ &= (\pi/4)(0.060^2 - 0.054^2) \\ &= 5.37 \times 10^{-4}\ \mathrm{m}^2 \end{aligned}$$

Assuming an ideal situation where the borehole is fully cased and there is no net loss or gain of water flowing into or out of the surrounding soil formation, the drill water velocity (V) in the drilling annulus is given by $$\begin{aligned} V &= F/A \\ &= 0.015/60/5.37 \times 10^{-4} \\ &= 0.465\ \mathrm{m/s} \end{aligned}$$

The transit time (T) of drilling fluid in the drilling annulus is given by $$\begin{aligned} T &= L/V \\ &= 50/0.456 \\ &= 107\ \text{seconds} \end{aligned}$$

In practice, if leakage loss of drilling fluid occurs into the surrounding formation in an uncased section of the borehole, the return flow is reduced and the response time is proportionately longer. However the return flow retains a dissolved gas concentration representative of that in the intercepted formation. The detection limit of gas concentration will depend on the measurement sensitivity of the gas sensor and the dilution factor attributable to the drilling fluid.

FIG. 2 illustrates graphically the typical sequence of a gas interception event during drilling. Continuing the above example, with a typical bit penetration rate of 4 mm/s the hole will advance only about 430 mm during the 107 seconds measurement delay period. The in situ concentration of dissolved gas may be calculated from the dilution ratio of cut material to drilling fluid flow rate. For example a B-sized coring bit with outer diameter 60 mm and inner diameter 44 mm will cut $5.23 \times 10^{-6}$ $m^3/s$ when the penetration rate is 4 mm/s, giving a dilution ratio of 48:1 when the drilling fluid flowrate is 15 L/min. A typical methane sensor has a measurement sensitivity in the range 300 nmol/L to 10 μmol/L, thus the lower detection limit of in situ dissolved gas concentration is 48×300 nmol/L, or approximately 15 μmol/L.

A lower dilution and higher sensitivity is obtained if the hole is bored with a non-coring bit and/or a lower drilling fluid flowrate. In the foregoing example the dilution ratio is 22:1 if a non-coring bit is used with a fluid flowrate of 15 L/min, i.e. the in situ dissolved gas concentration is 22 times the concentration measured in the drilling fluid returns and the lower detection limit of in situ dissolved gas concentration is 22×300 nmol/L, or approximately 7 μmol/L.

A more precise measurement of the in situ dissolved gas concentration can be obtained by conducting the drilling process over a defined length according to the steps of:

(a) Allowing the measured gas concentration to dissipate to zero or to stabilize to a base value
(b) Advancing the drilling over a defined penetration length
(c) Recording the gas concentration in the drilling fluid returns as a function of time
(d) Stopping the drilling while pumping fluid to the bit
(e) Allowing the measured gas concentration to dissipate to zero or to stabilize to the base value
(f) Integrating the gas measured response curve to calculate the total volume of gas released in the defined penetration length
(g) Calculating the volume of material cut from the defined length of borehole
(h) Dividing the calculated volume of gas by the volume of cut material.

The total volume of dissolved gas in step (f) is represented by the shaded area under the measured gas concentration curve shown in FIG. 2. In practice, if leakage loss of drilling fluid to the formation occurs this method will understate the total dissolved gas. However by measuring the exit flow in the discharge pipe with a suitable instrument such as a doppler flowmeter and comparing with the measured drilling fluid input flowrate, a correction can be applied. It is also possible that leakage flow into the borehole may occur from the surrounding formation. Depending on whether the inflow carries gas or just water the in situ concentration will be either over- or under-estimated. Inflow of gas may be detected by cycling the flushing water on and off without drilling and monitoring the gas sensor response for corresponding changes in dissolved gas concentration. Alternatively, to preclude leakage inflow, procedures may be adopted to ensure the drilling fluid pressure remains higher than the static pressure in the non-cased section of the borehole.

In the further aspect of the invention, the device may be a downhole probe assembly provided to detect and analyse in situ seabed gas in an established borehole. The probe assembly may include a hydrocarbon sensor or other type of gas sensor and may be deployed via the drillstring from a remotely operated seabed system to any known depth in the borehole. The probe may also be adapted to be pushed ahead in suitable ground conditions and penetrate the soil at the base of a borehole, to monitor the pore water dissolved gas concentration together with other parameters such as temperature and pressure. Water from the borehole can permeate into a small sensor chamber, located behind a protective cap at the end of the probe assembly. The sensor chamber can also be flushed with clean seawater drawn from the vicinity of the seabed rig, whenever a 'zero' reading is required.

The probe assembly also includes means for powering the gas sensor and for continuously logging and transmitting the sensor output signals in real time to the seabed system and thence to a remote operating station on the surface vessel. Using the down-hole probe, information about the rate of gas diffusion through the surrounding strata can complement laboratory analysis of hydrocarbons taken by conventional gas sampling probes.

Preferred embodiments of the invention will hereinafter be described with reference to the accompanying drawings.

LIST OF FIGURES

Figures 3A, 3B, 3C:
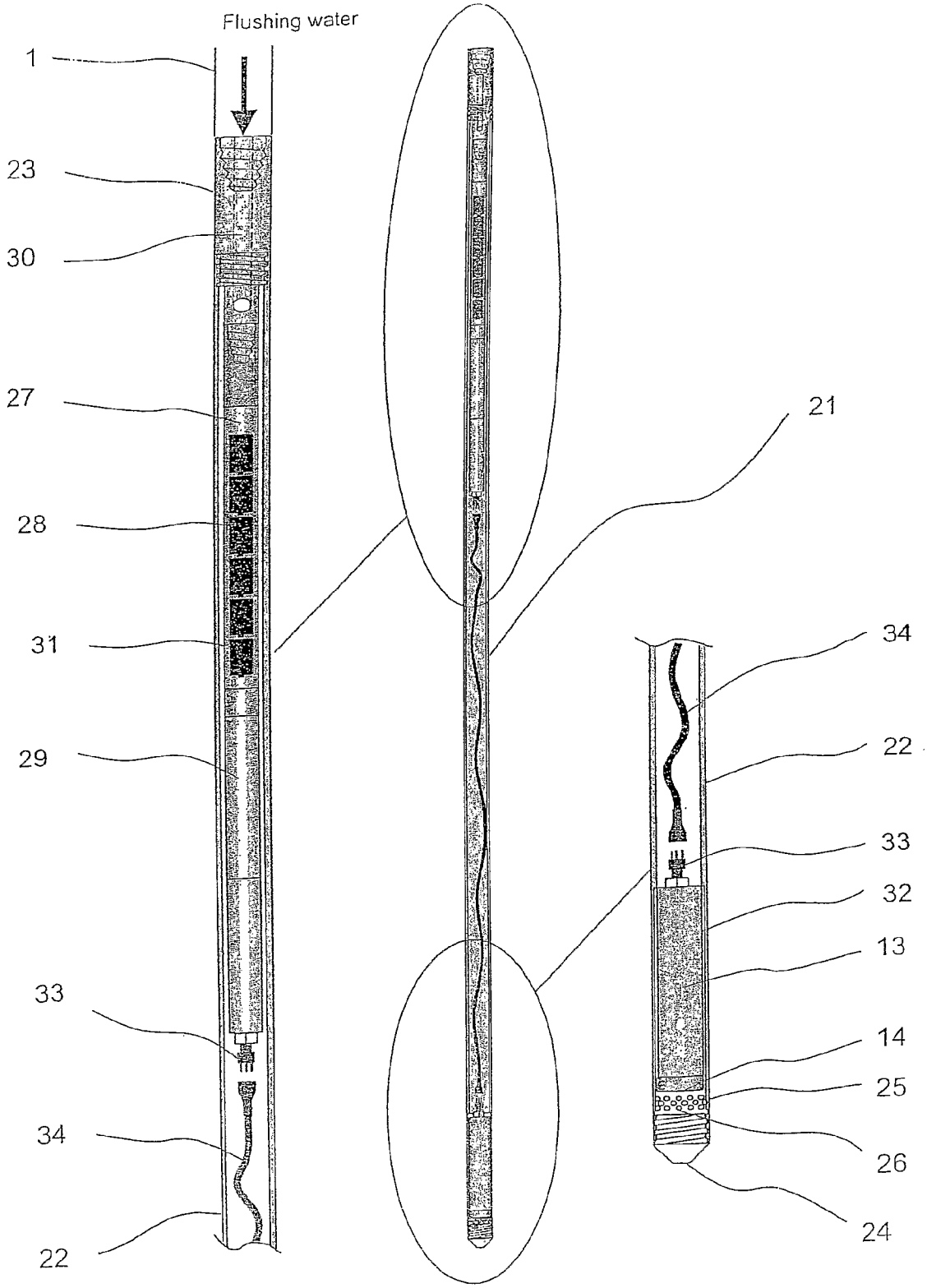

FIG. 3*a* shows a cut-away view of the downhole gas monitoring probe with enlarged views of the upper and lower sections of the probe.

FIG. 3*b* is a detail of one part of the probe shown in FIG. 3*a*.

FIG. 3*c* is a detail of another part of the probe shown in FIG. 3*a*.

Figure 4:
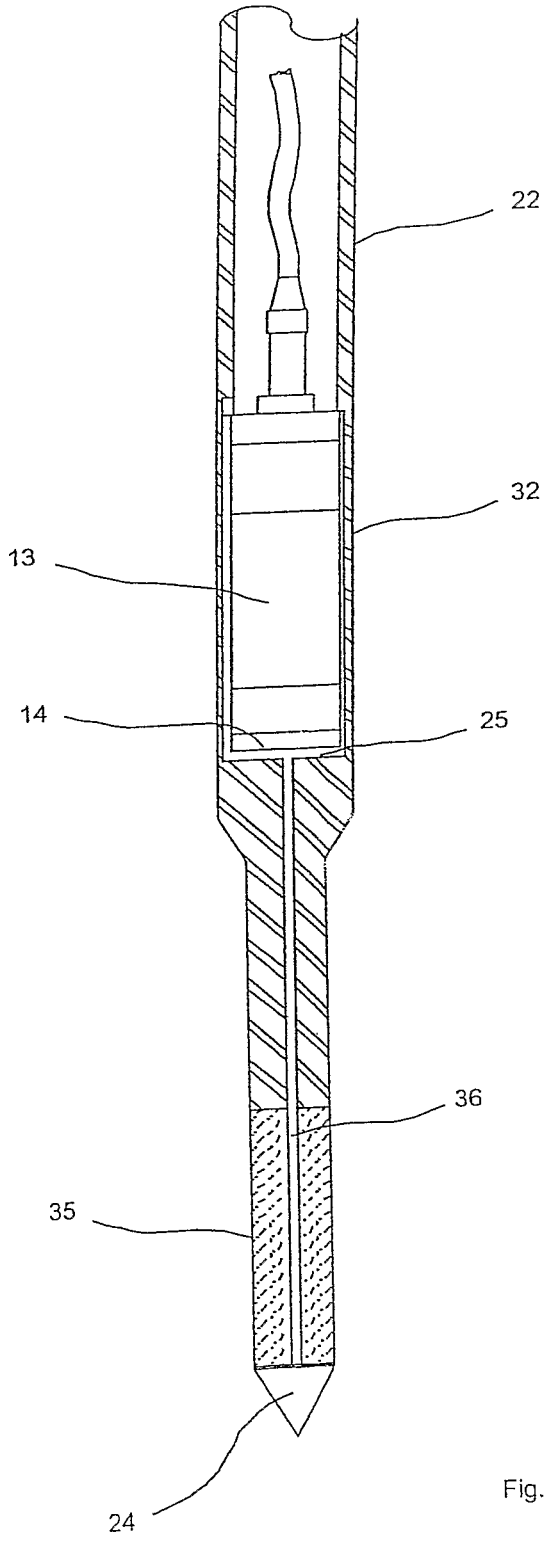

FIG. 4 shows a cross-sectional arrangement of a gas sensing soil probe.

DESCRIPTION OF PREFERRED EMBODIMENTS OF THE INVENTION

Figure 1:
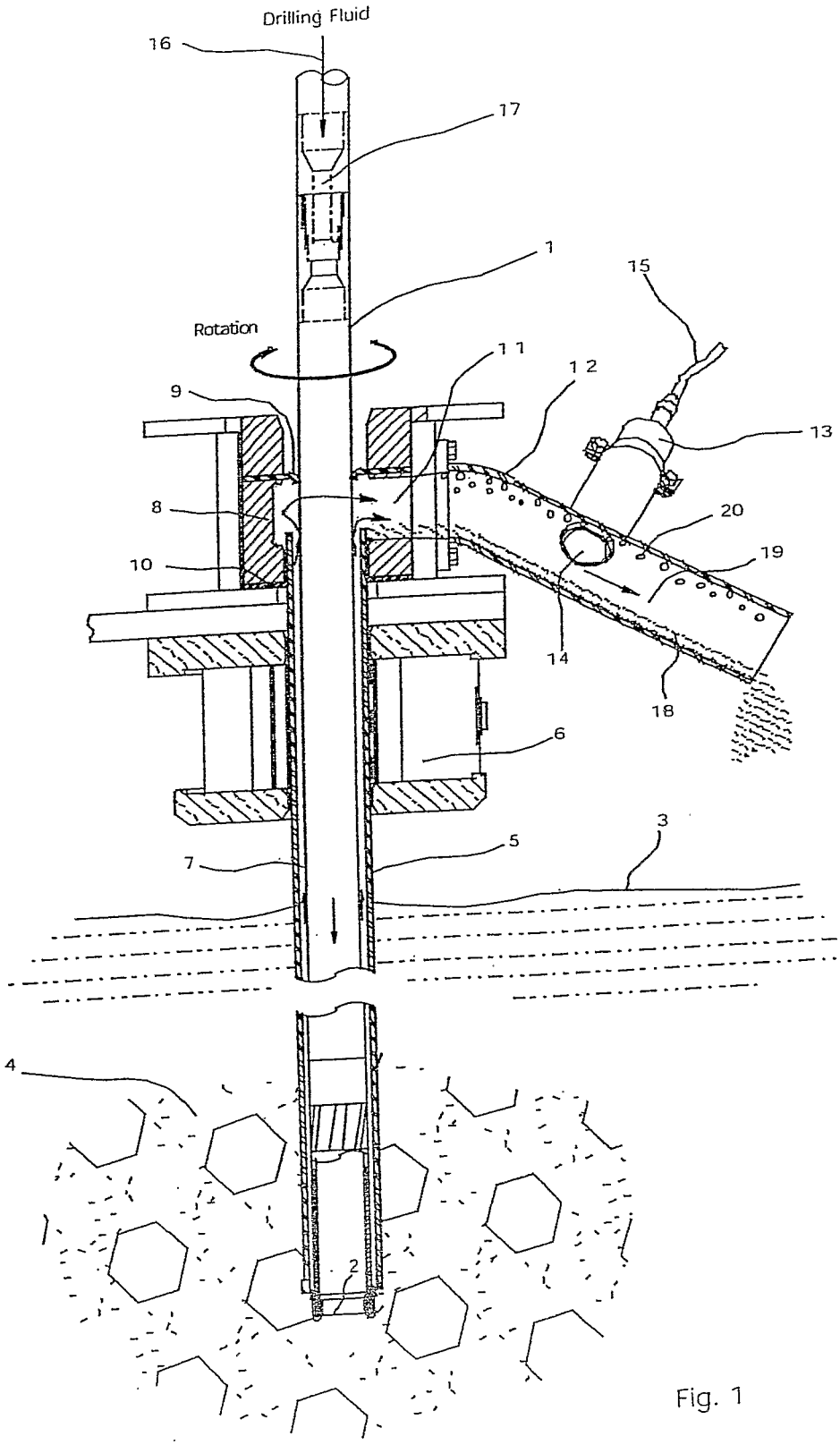
FIG. 1 shows a cross-sectional arrangement of the drilling fluid gas monitoring aspect of the invention.
Figure 2:
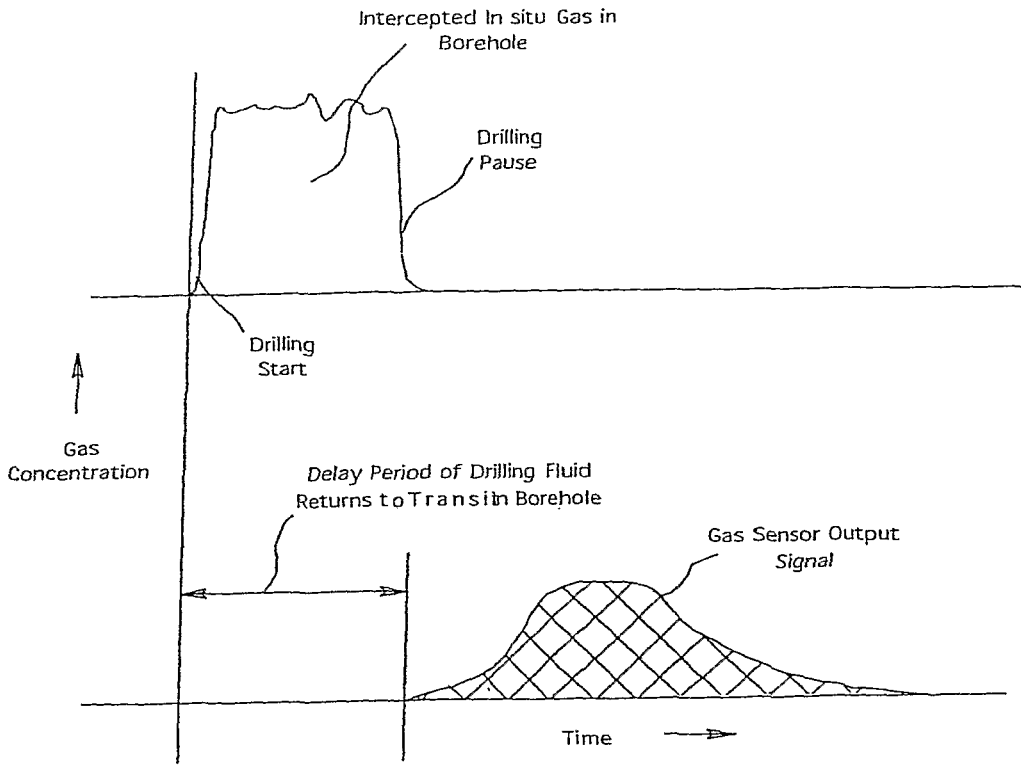
FIG. 2 represents a measurement response to intercepted dissolved gas released into the drilling fluid by the cutting bit.

With reference to FIG. 1, in a first aspect of the invention a rotating drillstring 1 equipped with a cutting bit 2 is associated with a remotely operated seafloor drilling rig situated at the seafloor 3. Drillstring 1 forms a borehole as it penetrates a natural formation of seabed material 4 which may contain trapped or dissolved gas. Drillstring 1 passes through a casing pipe 5 which is set into the borehole and which may be advanced as the borehole deepens. The drilling rig is located on the borehole by a casing clamp 6 and there is a small annular gap 7 between the external diameter of drillstring 1 and the internal diameter of casing 5.

An annular collecting chamber 8 is located at the top of casing pipe 5 surrounding the point of entry of drillstring 1 into casing pipe 5. Collecting chamber 8 is provided with an upper seal 9 constructed of wear resistant resilient material in sealing contact with rotating drillstring 1, having sufficient compliance to accommodate possible eccentricity in the rotation of drillstring 1. Collecting chamber 8 is further provided with a lower seal 10 constructed similarly of wear resistant resilient material in sealing contact with casing pipe 5. Collecting chamber 8 is further provided with a discharge aperture 11 positioned between upper seal 9 and lower seal 10.

A discharge pipe 12 connects to discharge aperture 11 and is downwardly inclined away from collecting chamber 8. The upper section of discharge pipe 12 is adapted to contain a gas sensor 13 of a conventional underwater type, for example the METS methane detector manufactured by CAPSUM Technologie GmbH. Gas sensor 13 is mounted such that its sensing face 14 is disposed into discharge pipe 12 and is offset circumferentially from the top of discharge pipe 12. An underwater cable 15 connects gas sensor 13 to a power supply and telemetry system on the drilling rig.

In operation, pressurised drilling fluid 16 is introduced at the top of drillstring 1 and flows downwards though the central passage 17 in drillstring 1 to exit at the cutting face of cutting bit 2. Drilling fluid 16 picks up the material being cut from the borehole, including any released gas, and the mixture flows upward through annulus 7 to emerge in collecting chamber 8 and flow into discharge pipe 12. The area ratio between annulus 7 and discharge pipe 8 is such that the flow velocity and turbulence are substantially reduced in discharge pipe 8, inducing a vertical stratification in the flow. Cuttings particles in the coarser size fractions of sand and grit tend to segregate into a denser layer 18 flowing in the lower section of discharge pipe 8, while a predominantly aqueous portion 19 containing any dissolved gases flows in contact with inclined gas sensor face 14 in the upper section of discharge pipe 8. Gas sensor face 14 is thus swept by the flow of returned drilling fluid to provide a continuous measurement of dissolved gas concentration in seabed formation 4 being penetrated. Any free gas bubbles entrained in aqueous portion 19 rise into an uppermost predominantly gaseous portion 20 of the flowing mixture. Gaseous portion 20 bypasses gas sensor face 14 by virtue of the position and orientation of gas sensor face 14 with respect to the stratified flow, thus avoiding direct contact of any free gas bubbles against sensor face 14.

Fluid pressure in collecting chamber 8 is slightly greater than ambient water pressure, thus avoiding possible dilution of the drilling fluid returns by inflow of water past seals 9 and 10. The measurement output signal is transmitted in real time to a remote operator station on the surface vessel.

At any time, the sensors can be 'zeroed' by flushing with clean seawater, drawn from an inlet several meters above the sea floor.

As the borehole advances in depth, casing pipe 5 may be extended by withdrawing drillstring 1 and adding pipe lengths incrementally such that the top of each new length of casing pipe 5 aligns within collecting chamber 8.

With reference to FIG. 3, in a further aspect of the invention a probe assembly 21 may be attached to the lower end of drillstring 1. Probe assembly 21 includes an outer tube 22, which connects at the upper end to a drill pipe adapter 23 and is terminated at the lower end with a hardened conical tip 24 or similar soil penetrating device. The lower end of outer tube 22 is also arranged to contain a gas sensor 13 of a conventional underwater type, for example the METS methane detector manufactured by CAPSUM Technologie GmbH. Gas sensor 13 may contain a number of output channels, each measuring a particular molecular weight hydrocarbon, also ambient temperature and pressure. A sampling chamber 25 is provided between tip 24 and gas sensor face 14, chamber 25 having a number of apertures or perforations 26 in the wall which permit contact of external fluid with gas sensor face 14.

Tube 22 contains an electronics assembly which preferably includes an acoustic transmitter 27, battery pack 28 and data logger module 29 of conventional type such as that manufactured by Geotech AB for use in a cordless CPT system. The electronics assembly is connected to the lower end of drill pipe adapter 23, extending axially inside tube 22. An internal flow path is provided between drillstring 1 and sampling chamber apertures 26, interconnecting via a water passage 30 in drill pipe adapter 23, an annular passage 31 formed between the electronics assembly and tube 22, then through the bore of tube 22 and an annular passage 32 formed between sensor 13 and tube 22. Data logger module 29 and gas sensor 13 are provided with electrical connectors 33 of conventional underwater type such as Seacon 'All Wet' series and an interconnecting cable assembly 34. In a particular variant of the invention, tube 22 may contain an additional battery pack which separately powers gas sensor 13.

With reference to FIG. 4, probe assembly 21 may alternatively terminate with soil penetrating apparatus which includes a porous element 35 such as a sintered filter, and an internal passage 36 interconnecting to chamber 25.

The method of operation of probe assembly 21 may include as follows the steps of:

(a) Remotely connecting probe 21 to the end of a drillstring, or other seabed penetrating apparatus
(b) Lowering probe 21 a known distance into a borehole
(c) Flushing clean seawater though sampling chamber 25
(d) Pushing probe 21 into the soil at the bottom of a borehole
(e) Allowing pore water from the borehole strata to permeate through openings 26 or porous element 35 and passage 36 to contact gas sensor face 14
(f) Recording via data logger 29 gas concentration, temperature and pressure data measured by sensor 13 and simultaneously transmitting the data signals via acoustic transmitter 27 to a remotely operated seabed apparatus, thence in real time to a remote operator station on the surface vessel.

The reference to any prior art in this specification is not, and should not be taken as, an acknowledgment or any form of suggestion that that prior art forms part of the common general knowledge in Australia.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

Finally, it is to be understood that various alterations, modifications and/or additions may be incorporated into the various constructions and arrangements of parts without departing from the spirit or ambit of the invention.

The invention claimed is:

1. Underwater gas monitoring apparatus associated with remotely operated seabed survey equipment, the apparatus including a detector which includes a collector for continuously collecting drilling fluid returns and contacting the drilling fluid returns with an underwater gas sensor so as to enable detection and measurement in real time the interception of gas in a bore hole, the collector including a collecting chamber for receiving the drilling fluid returns which result from a drilling operation, the drilling fluid returns including fluid containing solids from the drilling operation and, if present, dissolved gas, the apparatus further including a discharge conduit for discharging the drilling fluid returns from the collecting chamber, the collecting chamber and the discharge conduit being configured so that the drilling fluid returns is discharged in a stratified flow which includes a predominantly dissolved gas containing phase, the underwater gas sensor associated with the discharge conduit and positioned so as to sense any gas in the predominantly dissolved gas containing phase.

2. Apparatus according to claim 1 which is suitable for use with a drilling rig for drilling into a sea bed, the drilling rig including a drill string, the apparatus including a housing, a collector including a collecting chamber therein for receiving drilling fluid returns which result from a drilling operation, the drilling fluid returns including fluid containing solids from the drilling operation and, if present, dissolved gas, the apparatus further including a discharge conduit for discharging the drilling, fluid returns from the collecting chamber, the collecting chamber and discharge conduit being configured so that the drilling fluid is discharged in a stratified flow which includes a predominantly dissolved gas containing phase and if present a free gaseous phase, the apparatus further including a gas sensor associated with the discharge conduit and positioned so as to sense any gas in the predominantly dissolved gas containing phase.

3. Apparatus according to claim 1 including a gas monitoring probe assembly suitable for use with a drilling rig for drilling into a sea bed, the drilling rig including a drill string, the gas monitoring probe assembly including a housing attachable to one end of the drill string and which includes a gas sensor having a gas sensor face within the housing.

4. Apparatus according, to claim 2 wherein the drilling rig further includes a tubular casing which, in use, is disposed within a bore hole in the sea bed and the drill string is adapted to pass therethrough there being generally annular space between an inner wall of tubular casing and the drill string through which the drilling fluid returns can pass, said housing being operatively mounted to the tubular casing so that the drilling fluid returns can enter the collecting chamber.

5. Apparatus according to claim 2 wherein said gas sensor includes a sensing face within the discharge conduit so as to contact the predominantly dissolved gas containing phase if present.

6. Apparatus according to claim 2 wherein said housing is spaced from the seabed and said discharge conduit extends from one side of the collecting chamber and towards the seabed.

7. Apparatus according to claim 3 further including a soil penetrating tip at one end of the housing.

8. Apparatus according to claim 3 said gas monitoring probe assembly including openings or interconnecting passages to allow pore water to permeate from the borehole strata to the gas sensor face.

9. Apparatus according to claim 3 including internal connecting passages between the drillstring and the gas sensor face to allow flushing of the sensor face with clean water.

10. A probe according to claim 3 including means for recording and simultaneously transmitting measured data signals in real time to a remote operator station.

11. Apparatus according to claim 4 wherein the housing includes a passage extending therethrough, through which the drill string can pass, said collecting chamber being in fluid communication with the passage.

12. Apparatus according to claim 5 wherein the sensing face is disposed in an upper region of the discharge conduit but spaced from a top region so as to inhibit contact with the free gaseous phase if present.

13. Apparatus according to claim 8 wherein the openings or interconnecting passages are provided via a filter element of porous material.

14. Apparatus according to claim 11 wherein the casing extends into the passage.

15. Apparatus according to claim 14 further including a seal for sealing the collecting chamber with the drill string and the casing.

* * * * *